US007127781B2

(12) United States Patent
Ponting et al.

(10) Patent No.: US 7,127,781 B2
(45) Date of Patent: Oct. 31, 2006

(54) RELEASE DEVICE FOR A KITE

(75) Inventors: Ian Ponting, Makanao, HI (US); David Starbuck, New Territories (HK)

(73) Assignee: Neil Pryde Limited, New Territories (HK)

( * ) Notice: Subject to any disclaimer, the term of this patent is extended or adjusted under 35 U.S.C. 154(b) by 225 days.

(21) Appl. No.: 10/945,061

(22) Filed: Sep. 20, 2004

(65) Prior Publication Data

US 2006/0059665 A1 Mar. 23, 2006

(51) Int. Cl.
*F16G 11/00* (2006.01)

(52) U.S. Cl. ..... 24/136 R; 24/115 F; 24/136 K

(58) Field of Classification Search ..... 24/115 F, 24/115 K, 115 M, 115 R, 136 K, 136 L, 24/136 R; 294/67.1, 82.23, 82.25, 82.35; 182/232, 235, 192, 193, 3, 5, 231; 248/229.1, 248/925, 231.9, 231.91; 244/142, 153 R, 244/152, 155 A See application file for complete search history.

(56) References Cited

U.S. PATENT DOCUMENTS 3,972,496 A * 8/1976 Novorr ..... 244/155 R
4,385,740 A * 5/1983 Smith ..... 244/155 R
4,834,327 A * 5/1989 Byrne ..... 248/231.9
6,263,946 B1 * 7/2001 Cotten ..... 24/115 F
6,691,954 B1 * 2/2004 Harrington et al. ..... 244/155 A
6,830,220 B1 * 12/2004 Runyan ..... 244/155 A
6,869,047 B1 * 3/2005 Pouchkarev ..... 244/155 A
6,988,694 B1 * 1/2006 Barrs et al. ..... 244/155 A
7,017,860 B1 * 3/2006 Royannais et al. ..... 244/155 A
2004/0182968 A1 * 9/2004 Gentry ..... 244/155 A

FOREIGN PATENT DOCUMENTS

DE 102 42 454 A1 * 7/2002

* cited by examiner

*Primary Examiner*—Robert J. Sandy
*Assistant Examiner*—Ruth C. Rodriguez
(74) *Attorney, Agent, or Firm*—Alix, Yale & Ristas, LLP

(57) ABSTRACT

A safety release device for a kite line has a first fastening member with an attachment point for a first line portion and a second fastening member with an attachment point for a second line portion. In a fastened position the second fastening member engages through an aperture of the first fastening member. A release member is movably positioned on the first fastening member and is movable between a secured position holding hold the release device in the fastened position and a released position in which a line attached to the release device pulls the second fastening member out of engagement through the aperture. A releasable locking member is provided on the release member for locking the release member in the secured position so as to prevent it being moved to the released position.

4 Claims, 3 Drawing Sheets

RELEASE DEVICE FOR A KITE

BACKGROUND TO THE INVENTION

1. Field of the Invention

The invention relates to a safety release device for a kite, and in particular to a safety release device for releasably fastening together first and second portions of a kite line.

2. Description of the Prior Art

A user controls the power and direction of a kite by manipulating a control bar connected to the kite lines. In one configuration the control bar is arranged to slide long a center control line having a harness loop for attaching the kite to a harness hook worn by a user.

It is possible to loose control of the kite and be over powered. This can be particularly dangerous during launching when the user is on or near land, solid objects, spectators, and other kites. For this reason it is known to provide a safety release device in the central control line. If the user looses control of the kite or the kite becomes over powered the user lets go of the control bar and it is pulled along the center control line by the kite until it hits the release device. The release device which operates to break the center control line portions de-powering the kite.

However, when performing certain maneuvers the user must remove his or her hands from the control bar. A problem exists because this would result in the safety release device operating to de-power the kite.

SUMMARY OF THE INVENTION

It is an object of the present invention to provide a safety release device for a kite that overcomes or ameliorates the above problem. It is a further object of the present invention to provide a safety release device for fastening together first and second portions of a kite line that can be disabled by the user during riding.

According to the invention there is provided a safety release device for releasably fastening together first and second portions of a kite line, the safety release device comprising a first fastening member having a first end and a second end, the first end having a first attachment point for attachment of a first line portion extending away from the release device in a first direction and the second end having an aperture, a second fastening member having a tongue and a second attachment point for attachment of a second line portion extending away from the release device in an opposite direction, the release device having a fastened position in which the second fastening member engages through the aperture of the first fastening member and the tongue extends in the opposite direction, a release member movably positioned on the first fastening member and movable between a secured position for securing the tongue to hold the release device in the fastened position and a released position releasing the tongue such that tension on a line attached to the release device pulls the second fastening member out of engagement through the aperture, and a releasable locking member provided on or with the release member for locking the release member in the secured position so as to prevent it being moved to the released position.

Preferably, the locking member comprises a rotational body having a recess into which the first fastening member is receivable and rotatable between a first position in which the recess and the first fastening member are aligned and a second position in which the recess and the first fastening member are misaligned.

Preferably, the first fastening member is receivable in the recess when the first fastening member moves between the secured position and released position.

Preferably, the release member is manually movable to the released position while the locking member is in the locked position Further aspects of the invention will become apparent from the following drawings and description.

BRIEF DESCRIPTION OF THE DRAWINGS

Embodiments of the invention will now be described by way of example only and with reference to the accompanying drawings in which.

DESCRIPTION OF THE PREFERRED EMBODIMENTS

Figure 1:
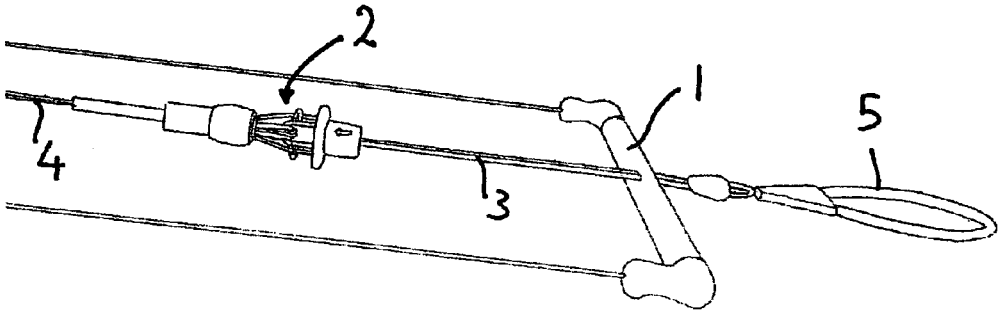
FIG. 1 shows a kite control system.
Figure 2:
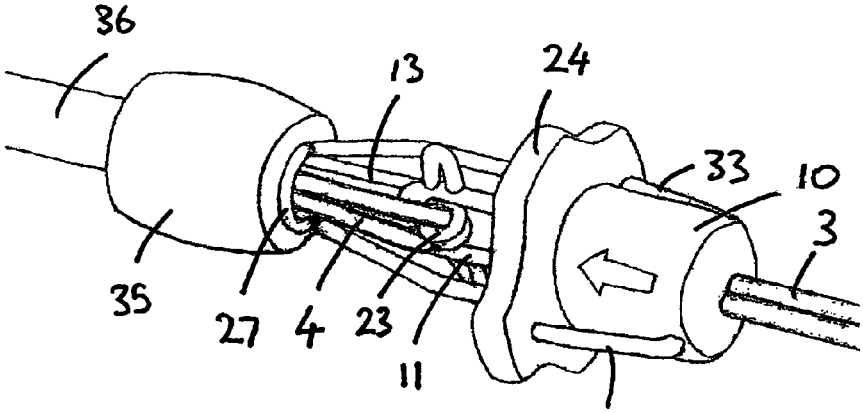
FIG. 2 shows a safety release device for fastening together first and second portions of a kite line.
Figure 4:
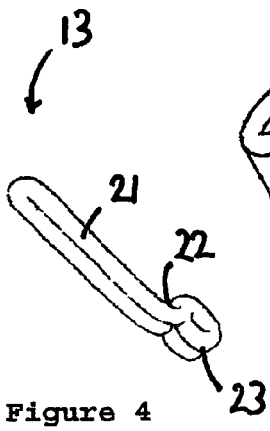
FIGS. 3 to 8 show parts of the safety release device.
Figure 5:
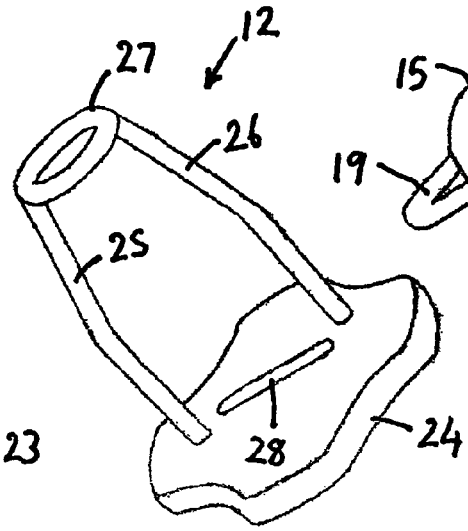
Figure 3:
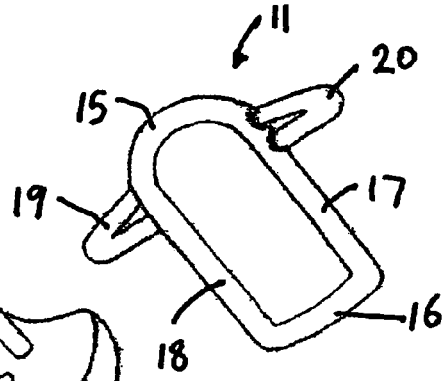
Figure 6:
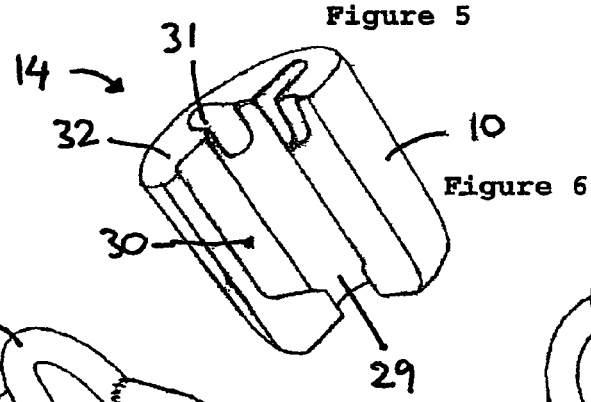
Figure 7:
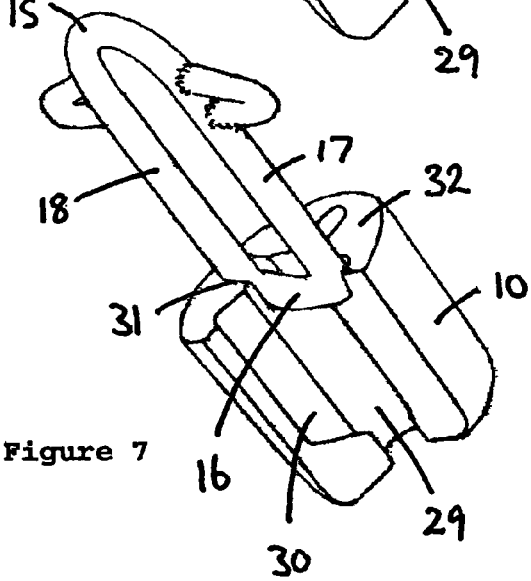
Figure 8:
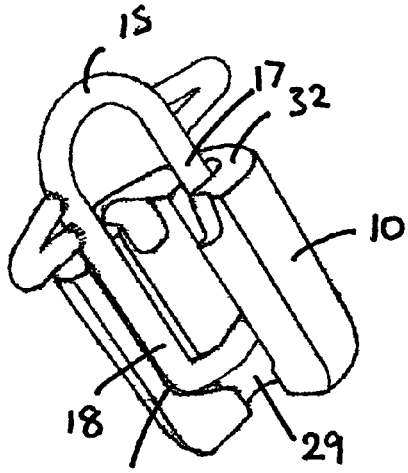

FIG. 1 shows a kite control system including a kite control bar 1 connected to kite lines. A safety release device 2 releasably fastens together two portions 3, 4 of the central control line. The control bar 1 slides long the center control line. At the proximate end of the control line is a harness loop 5 for attaching the kite to a harness hook worn by a user. The user controls power and direction of the kite by manipulating the control bar 1.

In the drawings there is depicted a safety release device for releasably fastening together the first and second portions 3, 4 of the center kite line. The device comprises a first fastening member 11, a second fastening member 12, a release member 13 movably positioned on the first fastening member 11 and a releasable locking member 14.

The first fastening member 11 comprises a rectangular slider having a first curved end bar 15, a straight second end bar 16 and two parallel side bars 17, 18 that define an aperture for receiving the second fastening member 12. Two triangular shaped tabs 19, 20 extend laterally from the two parallel side bars 17, 18 respectively. The first line portion 3 is attached to the second end bar 16 and extends in a first direction towards the harness loop 5.

The second fastening member comprises a tongue 21 bent at its proximate end to form a shoulder 22 with an attachment eyelet 23. The second line portion 4 is attached to the eyelet 23 and extends in an opposite direction towards the kite (not shown).

The release member 12 comprises a release knob 24 having two longitudinally extending bars 25, 26 supporting a securing ring 27. The release knob 24 has an elongate aperture 28 having a shape complementary to the first fastening member 11. The release member 12 is slidably located on first fastening member 11 with release knob 24 sliding along parallel side bars 17, 18. The triangular shaped tabs 19, 20 prevent the release member 12 from sliding off the front of first fastening member 11.

The locking member 14 comprises a generally cylindrical body 10 having a passage 29 extending through its centerline. An elongate recess 30, coaxial with the passage 29, extends from a first face 32 of the locking member 14 almost entirely through its depth. The recess 30 is a complementary shape to the first fastening member 11 so that it can be slidably received in the recess 30. A second shallow recess 31 is provided coaxial with passage 29 and at right angles to first recess 30. Second recess 31 is shallow so as to only receive the second end bar 16 of first release member 11.

Figure 9:
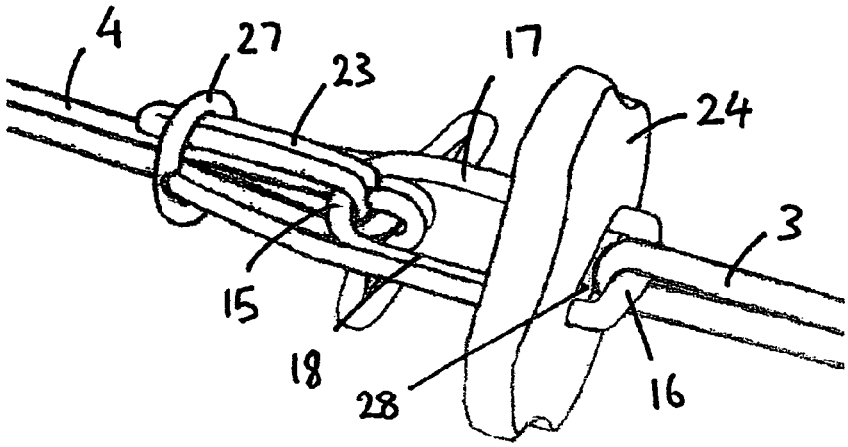
FIG. 9 shows the arrangement of the parts in FIGS. 3, 4 and 5.

In a fastened position, shown in FIG. 9, the second fastening member 13 engages through the aperture of first fastening member 11. The shoulder 22 bears against first end bar 15 of first fastening member 11. Tongue 21 and second line portion 4 extend in the opposite direction on opposite sides of end bar 15. Release knob 24 slidably engages on second fastening member 11 with ring 27 encircling the tongue 21 and second line portion 4 to hold the safety release device in the fasten position.

Figure 10:
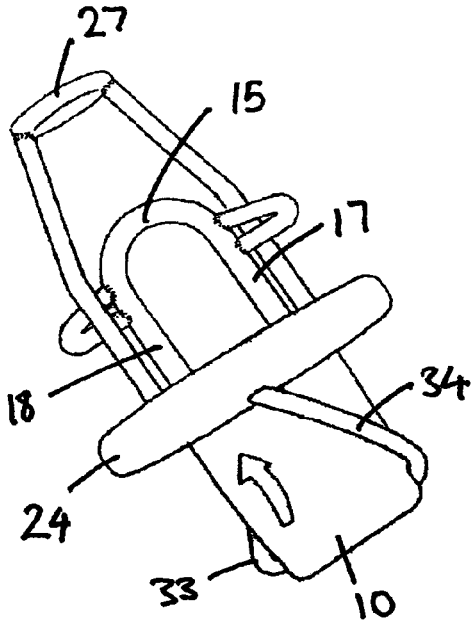
FIG. 10 illustrates the safety release device in a ready position.
Figure 11:
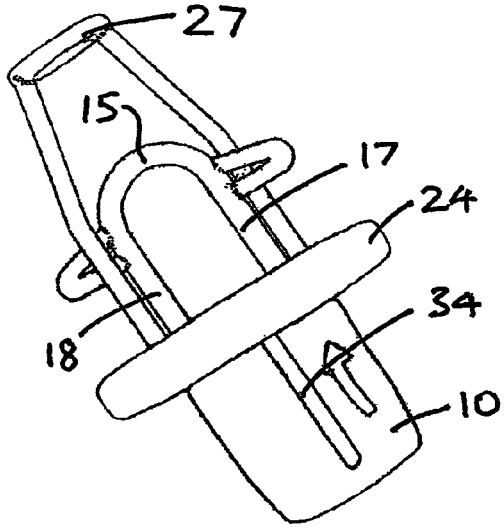
FIG. 11 illustrates the safety release device in a disabled position.

The locking member 14 is movably attached to release knob 24 by elastic shock cords 33, 34. First line portion 3 passes through passage 29. As shown in FIGS. 10 and 11 the locking member 14 may be rotationally moved between a locked position and an unlock position. In the lock position the locking member 14 is rotationally aligned so that second end bar 16 of first fastening element 11 locates within shallow bore 31. The locking device 14 cannot be moved forward by the control bar 1 striking it. This prevents the safety device being operated by a control bar release so a rider can let go of the control bar 1 to perform maneuvers.

The knob 24 of release fitting 12 is wider than the body 10 of locking member 14. This allows the user to push the release knob 24 independently of the locking member 14. The release knob 24 can be manually moved forward by the user, stretching shock cords 33, 34, while the locking device 14 is in the locked position to de-power the kite.

In the unlock position the locking member 14 is rotationally aligned so that first fastening member 11 is slidably received within first deep recess 30. In this position the release device is ready so that a control bar striking the safety release device will cause the locking member 14 and release member 12 to slide together along first fastening member 11 moving ring 27 away from tongue 21. The pull of the kite on a second line portion 4 pulls the second fastening member 12 out of engagement through the aperture causing the safety release device to operate.

A barrel shaped piece of foam 35 is used as a spring to hold the release member 12 in the fastened position. Nylon webbing 36 is sewn onto the second line portion 4 as a stop for the foam barrel 35. The barrel 35 fits between the webbing 36 and the ring 27. The foam barrel 35 is compressed when the release member 12 is moved along first release fitting 11.

The release device overcomes the problem with known release systems because the rider can turn locking member 14 to a ready position during launch or other situations when it might be dangerous if the kite becomes overpowered. When the rider wants to perform maneuvers which required him or her to remove their hands from the control bar 1 they can set the locking member 14 to the disabled position to prevent operation of the safety release device when the control bar strikes it.

What is claimed is:

1. A safety release device for releasably fastening together first and second portions of a kite line along which a kite control bar can move to operate the safety release device, the safety release device comprising:

a first fastening member having a first end and a second end, the first end having a first attachment point for attachment of a first line portion and the second end having an aperture, said first line portion extending away from the release device in a first direction and along which a kite control bar can move, a second fastening member having a tongue and a second attachment point for attachment of a second line portion extending away from the release device in an opposite direction, the release device having a fastened position in which the second fastening member engages through the aperture of the first fastening member and the tongue extends in the opposite direction, a release member movably positioned on the first fastening member and movable between a secured position for securing the tongue to hold the release device in the fastened position and a released position releasing the tongue such that tension on a line attached to the release device pulls the second fastening member out of engagement through the aperture, and a releasable locking member provided on or with the release member and having a locked position for preventing the release member being moved to the released position by the kite control bar moving along the first line portion.

2. The device of claim 1 wherein the locking member comprises a rotational body having a recess into which the first fastening member is receivable and being rotatable between an unlocked position in which the recess and the first fastening member are aligned and the locked position in which the recess and the first fastening member are misaligned.

3. The device of claim 1 wherein the locking member comprises a rotational body connected to the release member by a resilient cord and having a recess into which the first fastening member is receivable, the locking member being rotatable between an unlocked position in which the recess and the first fastening member are aligned and the locked position in which the recess and the first fastening member are misaligned.

4. The device of claim 1 wherein the release member is manually movable to the released position while the locking member is in the locked position.

* * * * *